US005259779A

United States Patent [19]

Ooya et al.

[11] Patent Number: 5,259,779

[45] Date of Patent: Nov. 9, 1993

[54] TWO PART FLOATING ELECTRIC CONNECTOR

[75] Inventors: Masaaki Ooya, Yokohama; Zenta Murakami, Fujisawa, both of Japan

[73] Assignee: Molex Incorporated, Lisle, Ill.

[21] Appl. No.: 991,792

[22] Filed: Dec. 17, 1992

[30] Foreign Application Priority Data

Dec. 30, 1991 [JP] Japan ..... 3-359550

[51] Int. Cl.[5] ..... H01R 13/629

[52] U.S. Cl. ..... 439/247; 29/856

[58] Field of Search ..... 439/246–248; 29/856

[56] References Cited

U.S. PATENT DOCUMENTS 4,810,215 3/1989 Kaneko ..... 439/845
4,941,836 7/1990 Bormuth ..... 439/247
5,057,027 10/1991 Yamada et al. ..... 439/83
5,201,663 4/1993 Kikuchi et al. ..... 439/248 X

*Primary Examiner*—Eugene F. Desmond
*Attorney, Agent, or Firm*—Stephen Z. Weiss

[57] ABSTRACT

Disclosed is an improved two part floating electric connector which prevents damage to a solder joint and deformation to terminals which are caused in coupling and decoupling conventional floating type connector parts when misalignment is present. The two part floating electric connector includes a housing body molded integrally with a collar and attached together by frangible bridging portions. A pair of fitting nails are fixed to the opposite ends of the outer stationary collar so that these nails may prevent the inner floating housing from rising above the outer stationary housing while allowing horizontal floating.

4 Claims, 9 Drawing Sheets

TWO PART FLOATING ELECTRIC CONNECTOR

FIELD OF THE INVENTION

The present invention relates to a two part floating electric connector and a method of making the same. A floating connector is affixed to the surface of one printed-circuit board and is adapted to mate with a non-floating type connector which is fixed to another printed-circuit board. When these printed-circuit boards are coupled, the two part floating connector self aligns the mating connectors during coupling.

DISCUSSION OF PRIOR ART

A conventional floating type electric connector comprises an inner floating housing and an outer stationary housing which is float-coupled to said inner floating housing by a plurality of terminals. The contact portions of these terminals are arranged at regular intervals and fixedly mounted in the inner floating housing and the solder tail portions of the terminals are fixedly mounted in the outer stationary housing. In making such conventional floating type electric connectors, the inner floating housing and the outer stationary collar are separately molded. These inner and outer moldings are coupled in floating condition by inserting the contact portions of the terminals in the terminal cavities of the inner housing and by inserting the tail portions of the terminals in the tail slots of the outer housing. These separate moldings cannot be combined with the terminals without putting the moldings in exact alignment prior to terminal insertion. This alignment, however, is difficult to attain, and misalignment if any, will prevent insertion of terminals. Difficulty of alignment prevents the full automation of making such floating type electric connector parts, thus necessitating manual assembly.

The conventional floating electric connector has the further disadvantage that with repeated coupling and decoupling the terminals are liable to cause a twist or pull which is violent enough to injure wire solder joints or deform selected terminals with the result that selected terminals provide an incomplete or deteriorated electrical connection between the printed-circuit boards.

One object of the present invention is to provide a two part floating electric connector which is guaranteed free of damaging a solder joint and/or of deforming terminals after repeated coupling and decoupling by allowing horizontal floating while accommodating for misalignment.

Another object is to provide a method of making such a two part floating electric connector.

SUMMARY OF INVENTION

In accordance with the foregoing objects, the present invention contemplates a two part floating connector adapted to be mounted on the surface of a printed circuit board. The connector includes a housing, a plurality of terminals and a collar integrally molded with the housing. The housing has a body with a given perimeter, a plurality of terminal receiving cavities therein open towards the bottom thereof and flanges extending from the bottom perimeter of the body overlying the printed circuit board. A plurality of terminals are mounted in the cavities. Each terminal has a board engaging portion for mating with the surface of the board and defining a surface mount connection, a mating portion for making electrical connection with a mating terminal and a flexible portion extending from the bottom of the body and connecting the mating portion to the board engaging portion.

A collar is molded integral with said housing and is attached to the housing by frangible bridging portions. The collar is fixedly mounted on the board engaging portion of the terminals and is spaced from the housing perimeter a given distance. The collar has a ledge extending over the housing flange in close proximity so that after the bridging portions are broken the housing can float horizontally no more than a given distance within the collar but not vertically with respect to the board.

The collar ledge may be in the form of two fitting nails fixedly mounted in the collar where each fitting nail has a portion overhanging the housing flange. The fitting nails may also have at least one mounting leg fixedly held in the collar at a position not overhanging said housing flange.

The present invention also contemplates a method of making the aforementioned two part floating electric connector comprising the steps of:

(a) forming a mold of an inner floating housing and an outer stationary collar which is integrally connected to said inner floating housing at its four corners by bridges, where the inner floating housing has terminal cavities laterally arranged at regular intervals for accommodating the contact portions of the terminals, and where the outer stationary collar has tail holding means to hold the board engaging portions of terminal;

(b) inserting the contact portions of terminals in the terminal cavities and fixing the board engaging portions of terminals by said tail-holding means;

(c) fixing a pair of nails to the opposite ends of the outer-stationary collar to prevent the rise of the inner floating housing from the outer stationary collar when the bridges are cut; and (d) cutting the bridges to separate the inner floating housing from the outer stationary collar, while holding the inner floating housing in floating condition relative to said outer stationary housing, thereby connecting the inner floating housing to the outer stationary collar by the terminals and the nails.

Other objects and advantages of the present invention will be understood from the following description of the two part floating electric connector according to the present invention, which is shown in the accompanying drawings and description.

DETAILED DESCRIPTION OF THE PREFERRED EMBODIMENT

Figure 12:
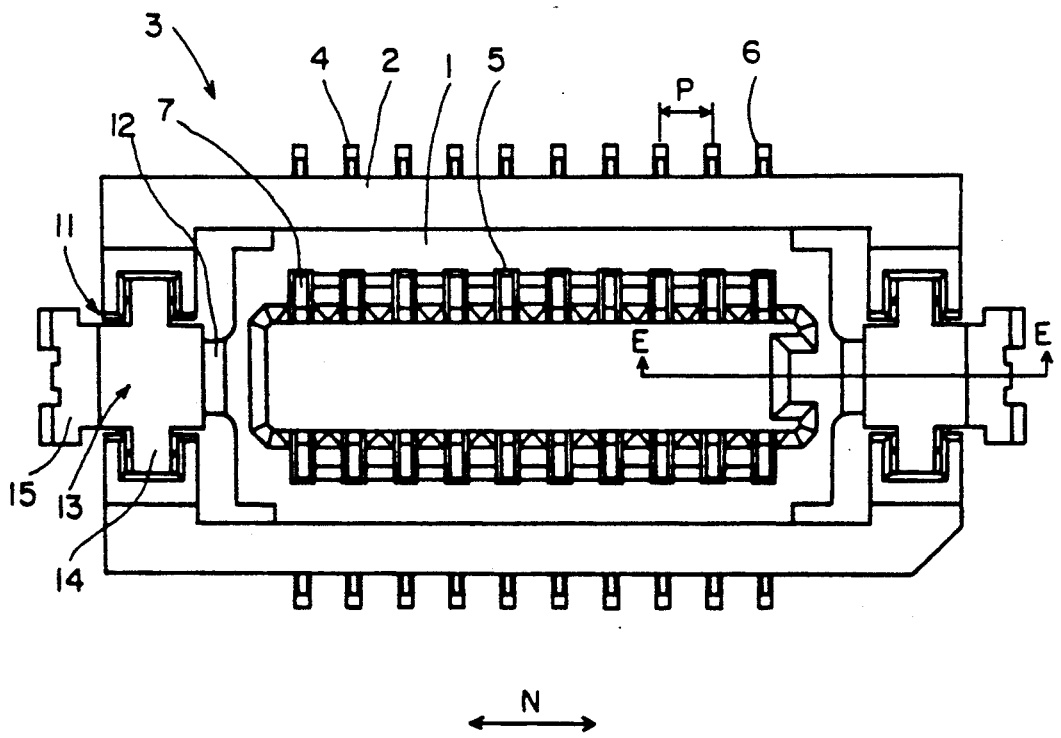
FIG. 12 is a plane view of the electric connector whose inner housing and outer stationary collar are separated by cutting and removing the bridges from their corners, the housing having terminals inserted and the collar having fitting nails attached thereto.
Figure 13:
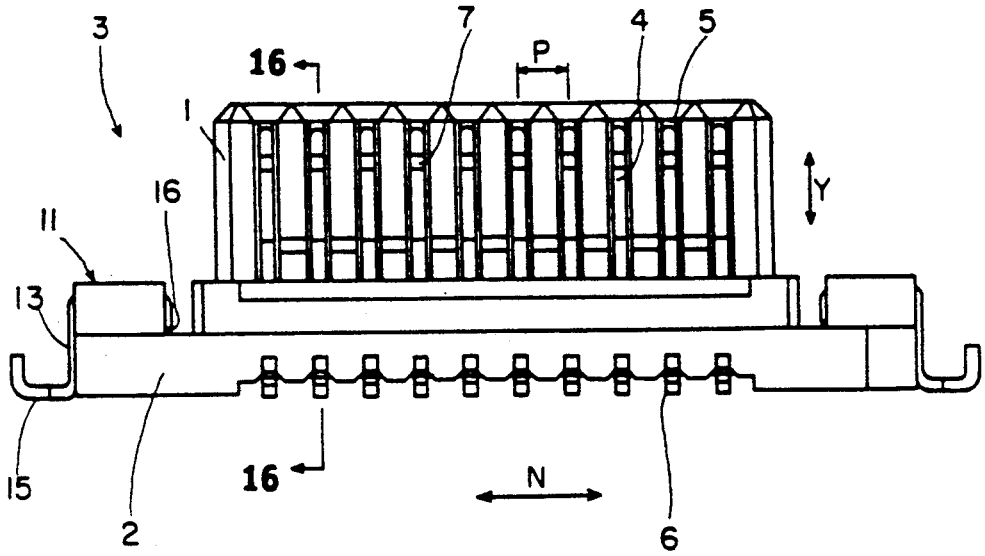
FIG. 13 is a front view of the electric connector in FIG. 12.
Figure 14:
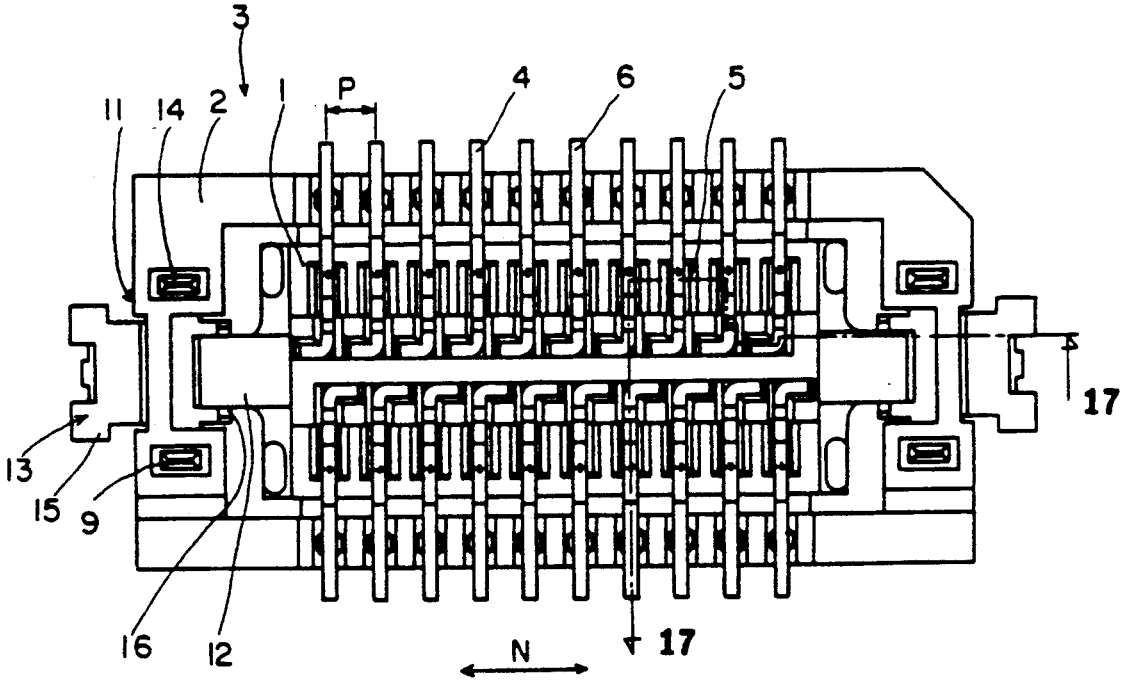
FIG. 14 is a bottom view of the electric connector.
Figure 15:
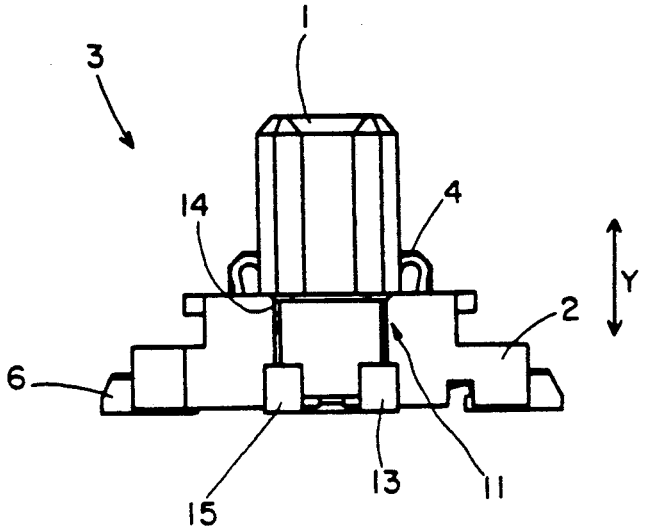
FIG. 15 is a right side view of the electric connector.
Figure 16:
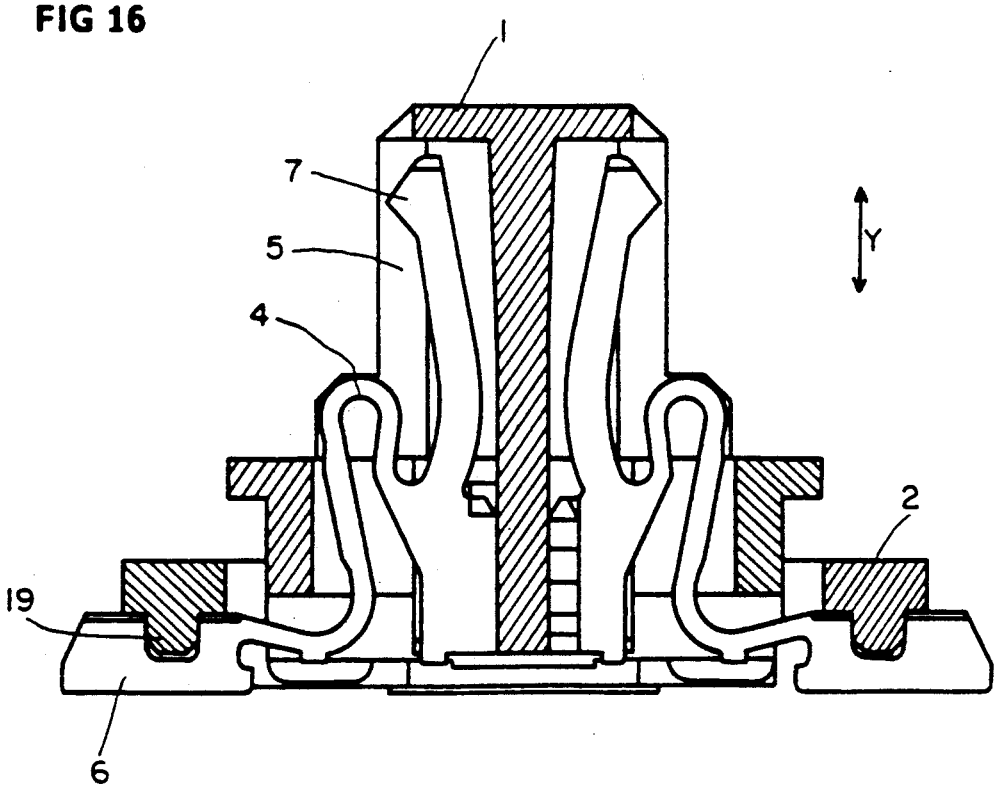
FIG. 16 is a sectional view of the electric connector taken along the line 16—16 in FIG. 13.

Referring to the drawings, particularly FIGS. 12–14, a floating electric connector 3 in its fully assembled condition comprises an inner floating housing with a given perimeter and an outer stationary collar 2 spaced from the inner floating housing 1 a given distance. The inner floating housing 1 is connected to the outer stationary collar 2 by terminals 4. Specifically, the inner floating housing 1 has a plurality of terminal cavities 5 made at regular intervals P laterally in the direction as indicated by arrow N. The contact portions 7 of terminals 4 are inserted in the terminal cavities of the inner floating housing 1. The outer stationary collar 2 has tail fixing projections 19, which hold the board engaging portions 6 of the terminals 4 (See FIG. 16). The floating electrical connector 3 is attached to one printed-circuit board with board engaging portions 6. When the floating electric connector 3 is coupled to a non-floating type connector on another printed-circuit board, the inner floating housing 1 can move relative to the outer stationary collar 2 can move horizontal no more than the given distance until misalignment, if any, between the mating connectors has been reduced.

Figure 2:
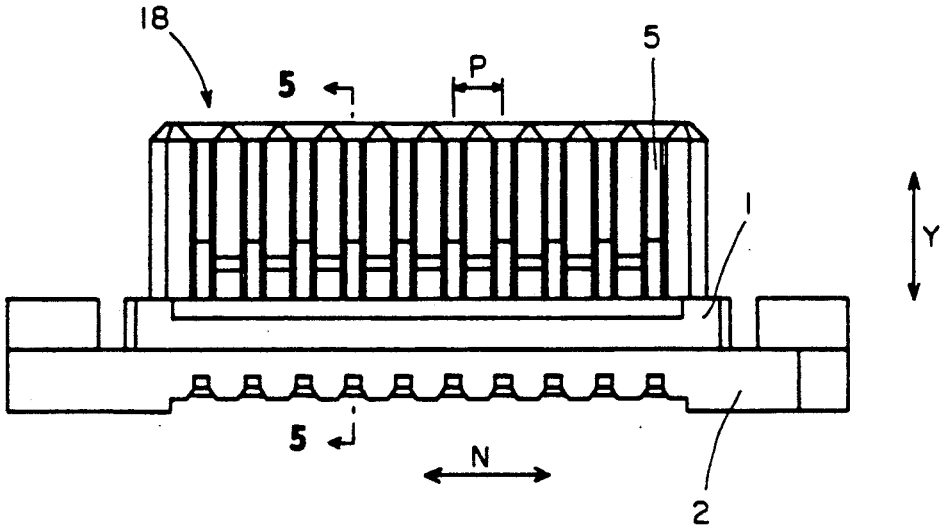
FIG. 2 is a front view of the inner housing and the outer integral stationary collar prior to insertion of associated terminals and nails.
Figure 3:
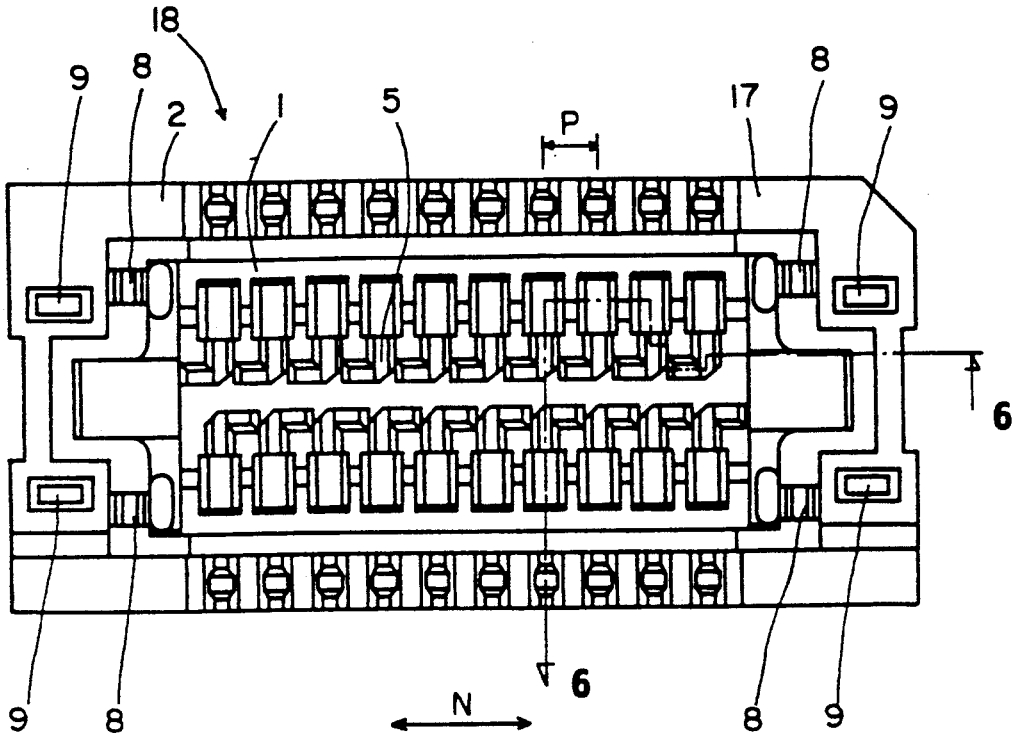
FIG. 3 is a bottom view of the inner housing and the outer integral collar prior to insertion of associated terminals and nails.
Figure 4:
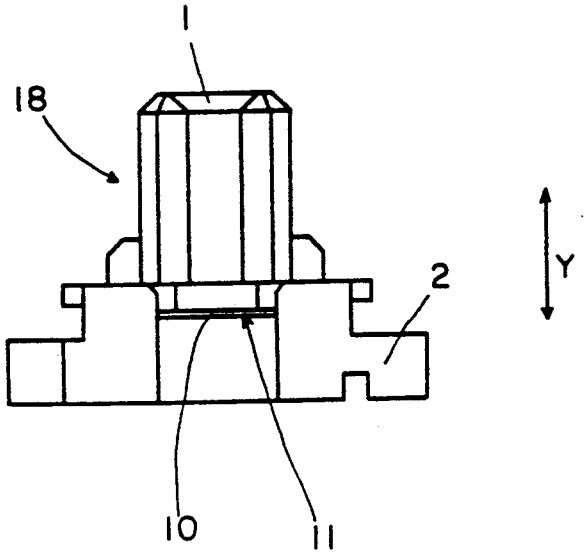
FIG. 4 is a right side view of the inner and outer integral housing mold prior to insertion of associated terminals and nails.
Figure 5:
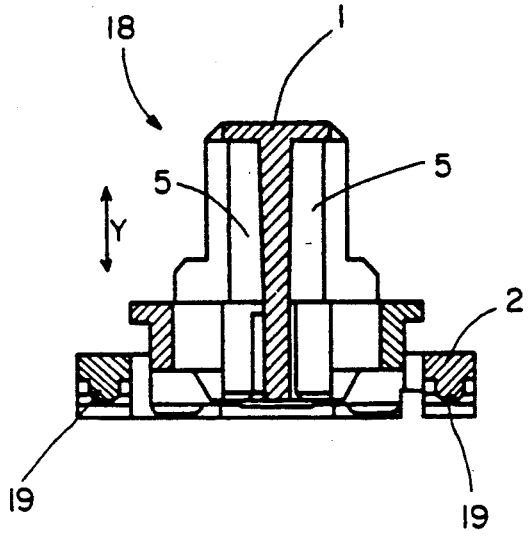
FIG. 5 is a sectional view taken along the line 5—5 in FIG. 2.
Figure 6:
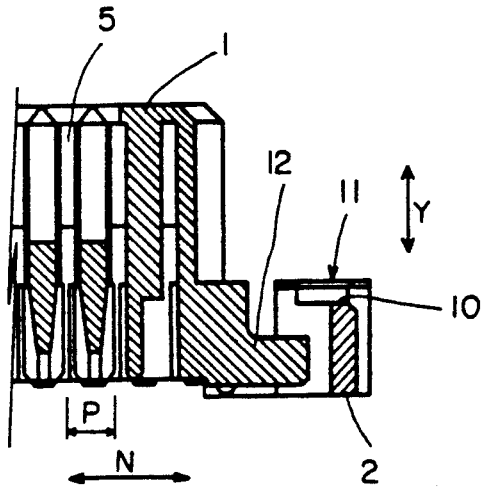
FIG. 6 is a sectional view taken along the line 6—6 in FIG. 3.
Figure 7:
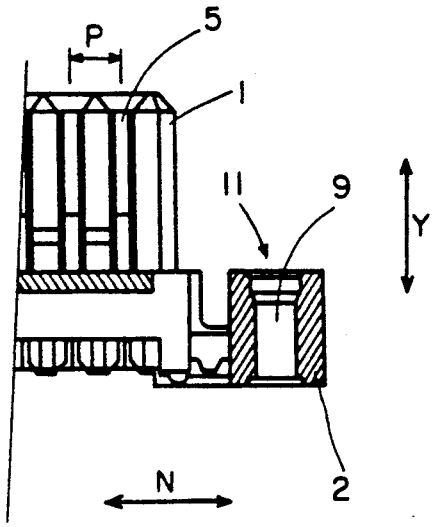
FIG. 7 is a sectional view taken along the line 7—7 in FIG. 1.

The method of making the floating electric connector described so far is described with reference to FIGS. 1 to 3. A mold of an outer stationary collar 2 which is integrally connected to the inner floating housing 1 at its four corners by frangible bridges 8, is formed. The contact portions 7 of terminals 4 are inserted into the terminal cavities 5 of the inner housing 1, and the board engaging portions 6 of the terminals 4 are attached to the tail-fixing projections 19 of the outer collar 2. Thereafter the bridges 8 are cut and removed to separate the inner floating housing 1 from the outer stationary collar 2.

Figure 1:
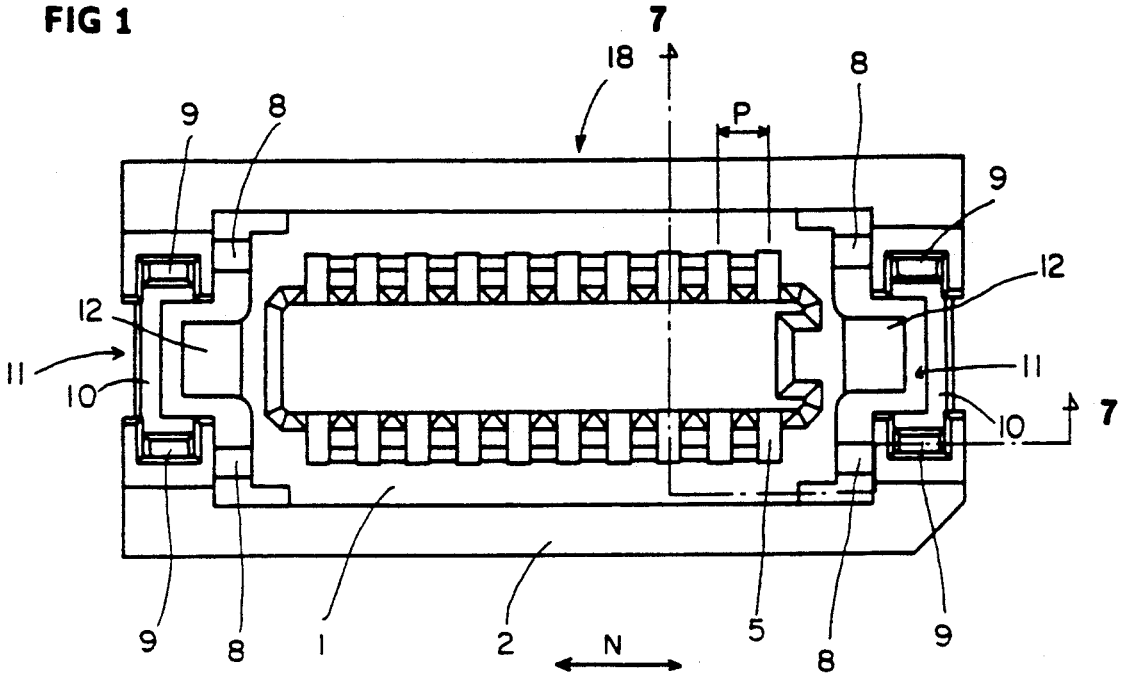
FIG. 1 is a plane view of the inner housing and the outer stationary collar integrally connected by four corners prior to insertion of associated terminals and nails.

Either end of the top of the outer stationary housing 2 has two opposite nail slots 9 and a nail seat 10 (See FIG. 1). These constitute together a nail location 11. The inner floating housing 1 has outward flanges 12 integrally connected to the opposite ends of the bottom of the inner floating housing 1. With this arrangement two fitting nails 13 are attached to the opposite nail locations 11 of the outer stationary collar 2 to prevent the rise of the inner floating housing 1 from the outer stationary collar 2.

Figure 8:
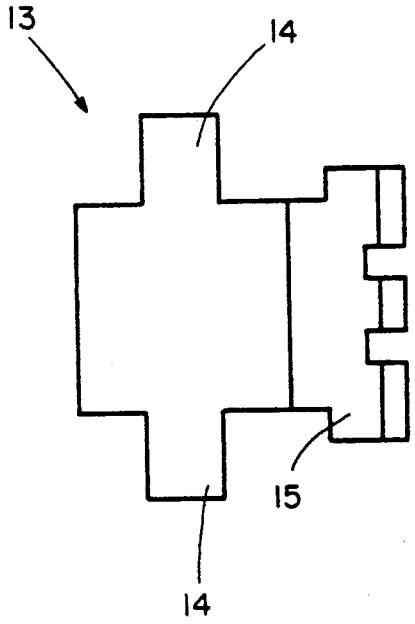
FIG. 8 is a plane view of the fitting nail.
Figure 9:
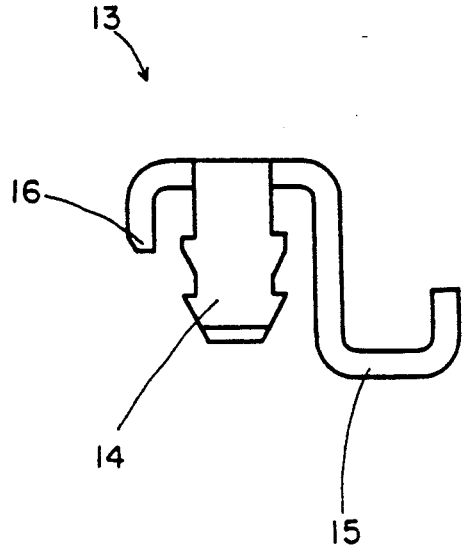
FIG. 9 is a front view of the fitting nail.
Figure 10:
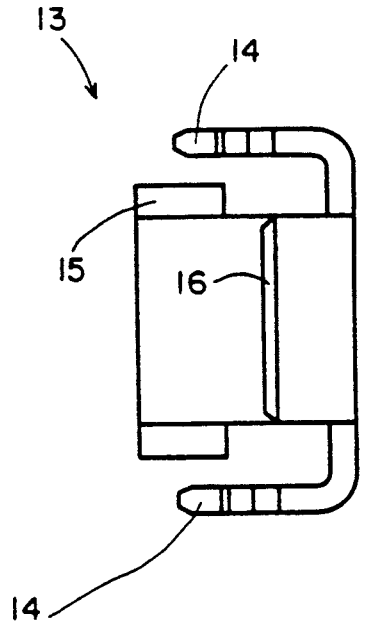
FIG. 10 is a left side view of the fitting nail.
Figure 11:
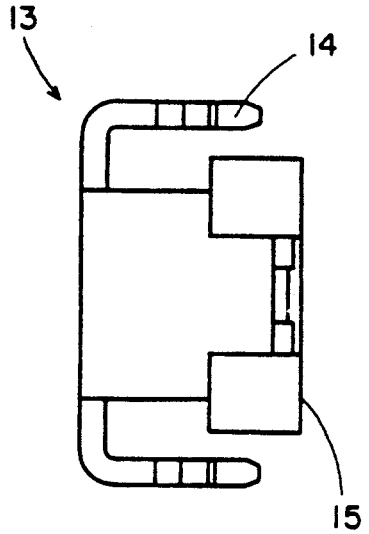
FIG. 11 is a right side view of the fitting nail.

Specifically, nail 13 has a pair of legs 14 integrally connected to an intermediate plate portion. These legs 14 are inserted in the opposite nail slots 9. Also, nail 13 has a forward overhead extension 16 and an L-shaped backward solder tail extension 15 both integrally connected to its intermediate plate portion (See FIGS. 8 to 10).

Figure 17:
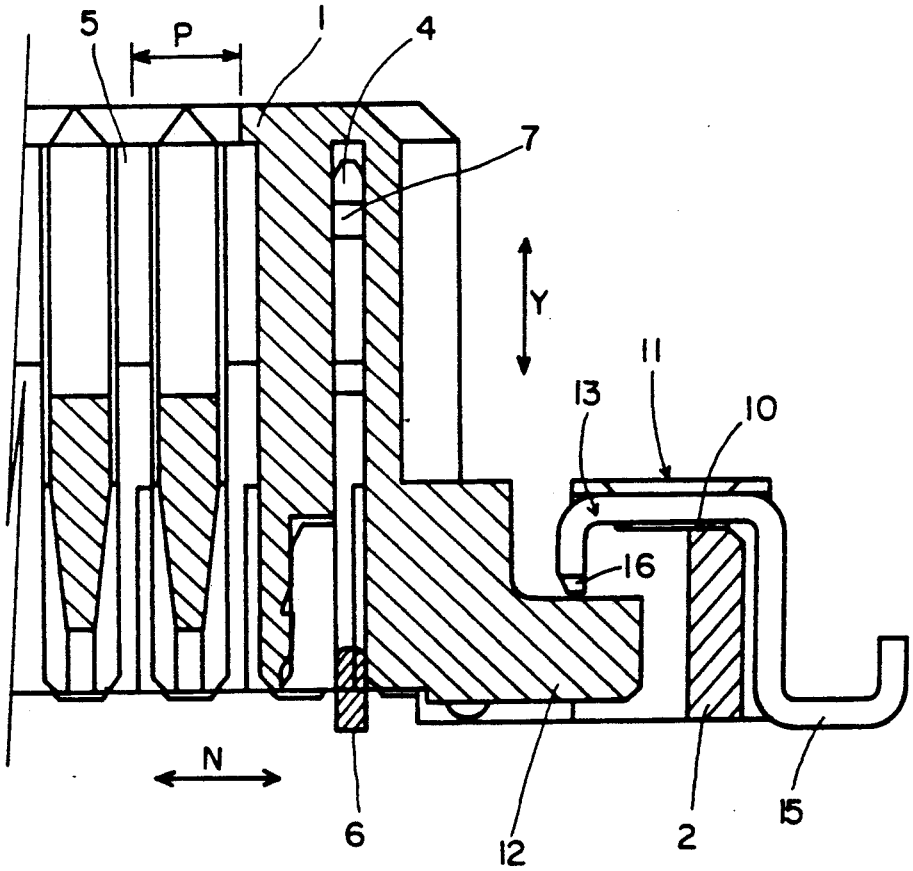
FIG. 17 is a sectional view of the electric connector taken along the line 17—17 in FIG. 14.

As best seen from FIG. 17, when attached to the nail location 11, the forward overhead extension 16 of the nail 13 extends inside of the outer housing 2 to leave a gap between the descending end of overhead extension 16 of the fitting nail 13 and the outward flange 12 of the inner housing 1 whereas the L-shaped backward solder tail extension 15 of the nail 13 appears out of the outer housing 2. The gap left between the descending end of the overhead extension 16 of the nail 13 and the outward flange 12 of the inner housing 1 is small enough to limit the rise (in the Y-direction) of the inner floating housing 1 from the outer stationary housing 2 to the extent that no terminals may be deformed.

The method of making the two part floating electric connector having nails attached thereto according to the present invention is described as follows. An integral mold is formed of the inner housing and the outer collar connected at four corners by bridges 8. The contact portions 7 of terminals 4 are inserted in the terminal cavities 5 of the inner housing 1 with the solder tails 6 of terminals 4 being fixed by the tail fixing projections 19 of the outer collar 2. A pair of nails 13 are attached to the opposite ends of the outer stationary housing 2 to prevent the rise of the inner floating housing 1 from the outer stationary housing 2. Finally, all bridges 8 are cut and removed from the four corners of each housing.

In use a floating electric connector 3 is fixed to a printed-circuit board by board engaging portions 6 while a conventional non-floating electric connector is fixed to another printed-circuit board. The floating and non-floating connectors are mated to make an electrical connection therebetween. When there is some misalignment between the connectors the floating inner housing 1 moves within the stationary outer collar 2 until such misalignment has been reduced. The inner floating housing 1 and outer stationary housing 2 are connected by the terminals, and at the same time, the inner floating housing 1 is prevented from moving upward from the outer stationary housing 2 beyond a prescribed permissible distance, thus preventing damage to the solder joints and/or deformation of selected terminals at the time of coupling and decoupling of the mating electric connectors.

We claim:

1. A two part floating connector adapted to be mounted on the surface of a printed circuit board, said connector including:

a housing having a body with a given perimeter, a plurality of terminal receiving cavities therein open towards the bottom thereof and flanges extending from the bottom perimeter of the body overlying said board; and a plurality of terminals mounted in said cavities, each terminal having a board engaging portion for mating with the surface of the board and defining a surface mount connection, a mating portion for making electrical connection with a mating terminal and a flexible portion extending from the bottom of the body and connecting the mating portion to the board engaging portion;

the improvement comprising:

a collar molded integral with said housing and attached to said housing by frangible bridging portions, said collar fixedly mounted on the board engaging portion of the terminals, said collar spaced from the housing perimeter a given distance and including a ledge extending over said housing flange in close proximity so that after said bridging portions are broken said housing can float horizontally no more than said given distance within said collar but not vertically with respect to the board;

whereby the horizontally floating housing will not compromise the integrity of the surface mount connection and the terminals.

2. A two part floating connector in claim 1 wherein said collar ledge is in the form of two fitting nails fixedly mounted in said collar each fitting nail having a portion overhanging the housing flange.

3. A two part floating connector in claim 2 wherein said fitting nails each have at least one mounting leg fixedly held in said collar at a position not overhanging said housing flange.

4. The method of making a two part floating electric connector comprising the steps of:

forming a mold of an inner floating housing with a given perimeter and flanges extending from the bottom perimeter of the housing and an outer stationary collar both of which are integrally connected together by frangible bridges, said collar spaced from the housing perimeter a given distance and including a ledge extending over said housing flange in close proximity said inner floating housing having terminal cavities laterally arranged at regular intervals for accommodating contact portions of terminals, and said outer stationary collar having tail holding means to hold board engaging portions of the terminals;

inserting the contact portions of terminals in said terminal cavities and fixing the board engaging portions of terminals by said tail-holding means;

fixing a pair of nails to the opposite ends of said outer stationary collar to prevent the rise of said flanges and said inner floating housing vertically from the board when the bridges are cut; and cutting said bridges to separate said inner floating housing from said outer stationary collar;

whereby said inner floating housing can float horizontally no more than said given distance within said outer stationary collar but not vertically with respect to the board so that the horizontally floating housing will not compromise the integrity of the surface mount connection and the terminals.

* * * * *